US006799446B1

(12) United States Patent
Tsai

(10) Patent No.: US 6,799,446 B1
(45) Date of Patent: Oct. 5, 2004

(54) COMBINATION LOCK CHANGEABLE IN COMBINATION

(75) Inventor: Cheng-Tao Tsai, Tainan (TW)

(73) Assignee: Jaeyou Co., Ltd., Tainan (TW)

( * ) Notice: Subject to any disclaimer, the term of this patent is extended or adjusted under 35 U.S.C. 154(b) by 0 days.

(21) Appl. No.: 10/720,209

(22) Filed: Nov. 25, 2003

(51) Int. Cl.[7] ..... E05B 37/02

(52) U.S. Cl. ..... 70/30; 70/26; 70/306; 70/311; 70/312; 70/317; 70/324

(58) Field of Search ..... 70/22, 25, 26, 70/30, 302, 305, 306, 309–312, 315–318, 324, 329–332, 446, DIG. 22, DIG. 44

(56) References Cited

U.S. PATENT DOCUMENTS 5,636,539 A * 6/1997 Tsai ..... 70/315
5,899,099 A * 5/1999 Tsai ..... 70/26
5,934,120 A * 8/1999 Kuo ..... 70/312
6,209,368 B1 * 4/2001 Lee ..... 70/312
6,422,051 B1 * 7/2002 Kuo ..... 70/312
2004/0079122 A1 * 4/2004 Tsai ..... 70/30
2004/0103700 A1 * 6/2004 Ling ..... 70/25

* cited by examiner

*Primary Examiner*—Lloyd A. Gall
(74) *Attorney, Agent, or Firm*—Rosenberg, Klein & Lee

(57) ABSTRACT

A combination lock includes a female member, a lock rod inserted in the female member; the female member is inserted through single dial, several actuating rings, and co-moving rings; the dial and the actuating rings are arranged side by side, and releaseably engaged with respective co-moving rings; the dial and an actuating ring adjacent thereto have a projecting portion on opposing sides while every two adjacent actuating rings have a projecting portion on opposing sides such that the co-moving rings can be turned to unlocking position where all gaps thereof oppose a trench of the female member to form a passage for the lock rod by operating the dial; orientations of the dial and the actuating rings relative to respective co-moving rings are changed for changing the unlocking combination by operating the dial after the dial and the actuating rings are disengaged from the co-moving rings.

8 Claims, 8 Drawing Sheets

COMBINATION LOCK CHANGEABLE IN COMBINATION

BACKGROUND OF THE INVENTION

1. Field of the Invention

The present invention relates to a combination lock, more particularly one, which is comprised of single dial, and whose unlocking numeral combination can be changed.

2. Brief Description of the Prior Art

Combination locks are usually used on suitcases, cable locks etc. The user of a combination lock only has to remember the unlocking numeral combination, and won't have the various problems with use of a key, e.g. losing the key, and the key getting damaged.

a male member 10, which has an insertion rod 101 having several aligned engaging teeth 102 equidistantly spaced along it;

a female member 20 having a holding tube 201 for insertion of the male member 10; the holding tube 201 having a trench formed along the whole length thereof, and a fitting trench 205 on a tail end thereof; the engaging teeth 102 of the male member 10 will project out from the trench of the trench of the holding tube 210 after the male member 10 is inserted in the holding tube 201;

several dials 202 arranged one next to another around the holding tube 201 of the female member 20; each of the dials 202 has numerals spaced out on an outer side, and a gap (not numbered) on an inward edge;

locating rings 203 fitted in respective dials 202 and around the holding tube 201 for helping locating the dials 202 when the dials 202 are being operated; each locating ring 203 has a gap opposing the trench of the holding tube 201; and a C-shaped ring 204 engaged with the fitting trench 205 of the female member 20 for preventing the dials 202 and the locating rings 203 from separating from the female member 20.

Thus, the lock will be in the locking position, wherein the male member 10 can't be separated from the female member 20, after the male member 10 is inserted in the holding tube 201, and the dials 202 turned such that the gaps thereof no longer oppose the trench of the holding tube 201. And, the male member 10 will be separable from the female member 20 after the dials 202 are turned to the unlocking orientation according to the unlocking numeral combination, wherein the gaps of all the dials 202 will oppose the trench of the holding tube 201 to form a passage, which allows the teeth 102 to pass through.

However, the user has to rotate all of the dials 202 in operating the combination lock. Consequently, the lock is not convenient to use. And, the lock can't be changed in the unlocking numeral combination to suit the user needs.

SUMMARY OF THE INVENTION

It is a main object of the present invention to provide a combination lock, which has single dial, but it is as difficult to find out the unlocking numeral combination as it is to find out combinations of conventional locks that have several dials.

It is another object of the present invention to provide a combination lock, which can be changed in respect of the combination.

The present lock has a female member, a lock rod inserted in a holding tube of the female member, a dial, several actuating rings, locating rings, and co-moving rings. The female member is inserted through the dial, the actuating rings, the locating rings, and the co-moving rings at the holding tube, which is formed with a trench along the whole length thereof. The dial and the actuating rings are arranged side by side, and releaseably engaged with respective co-moving rings. The dial and an actuating ring adjacent thereto have a projecting portion on opposing sides while every two adjacent actuating rings have a projecting portion on opposing sides such that by means of operating the dial, the co-moving rings can be turned to unlocking position where all gaps thereof oppose the elongated trench of the female member to form a passage, which allows spaced teeth of the lock rod to pass through. The locating rings are arranged in the dial and the actuating rings for locating the same and producing ticktack when the dial is being rotated to cause rotation of the actuating rings together with it. The orientations of the dial and the actuating rings relative to respective co-moving rings are changed for changing the unlocking combination by operating the dial after the lock has been unlocked, and the dial and the actuating rings disengaged from the co-moving rings.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
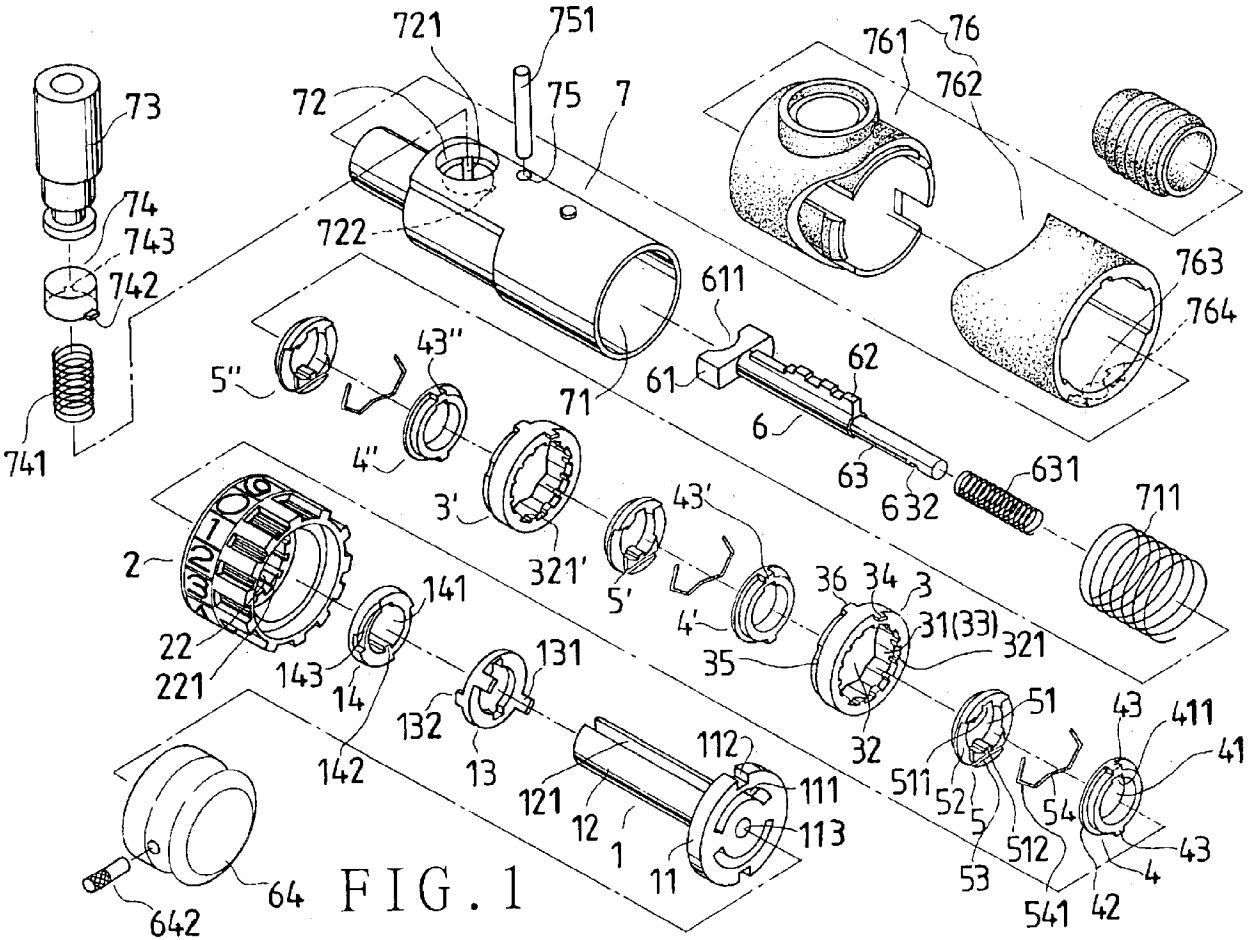
FIG. 1 is an exploded perspective view of the combination lock according to the present invention.
Figure 2:
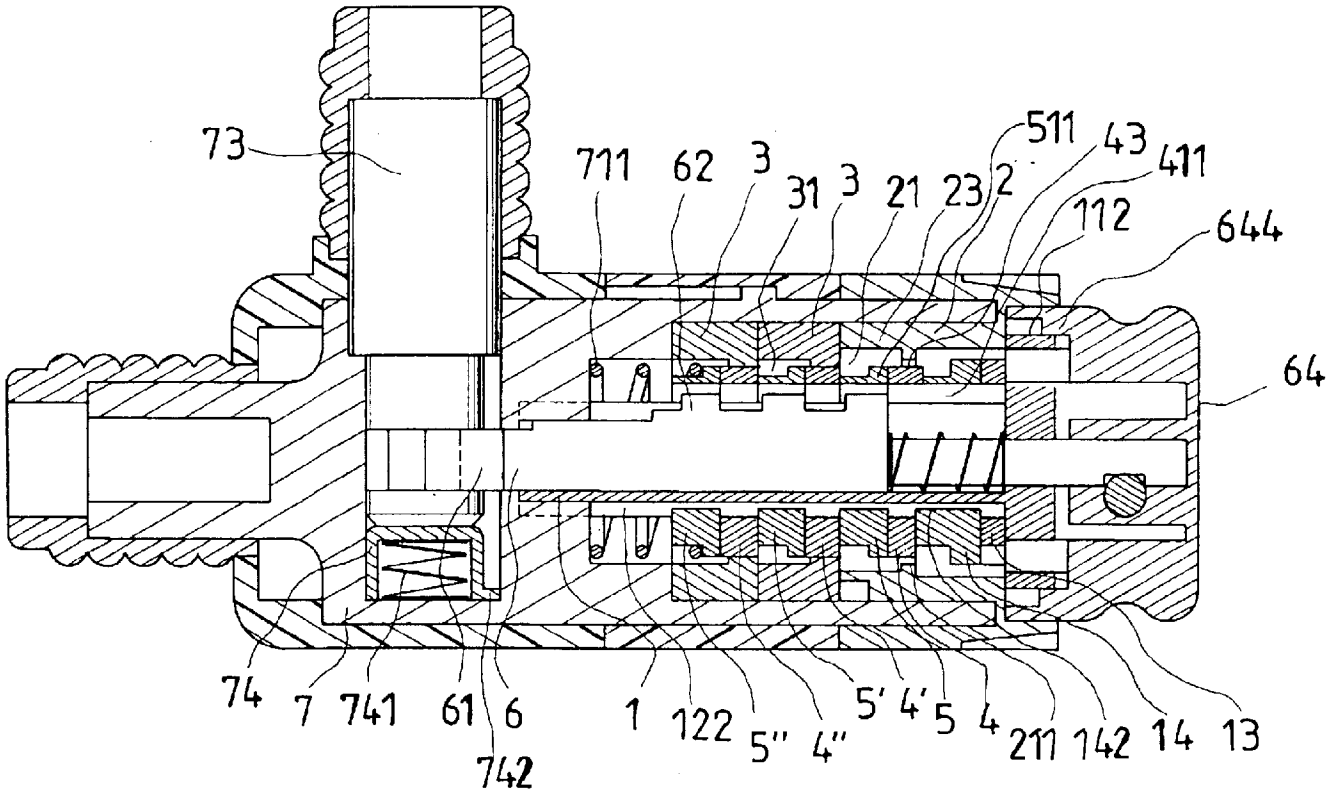
FIG. 2 is a vertical section of the combination lock according to the present invention.
Figure 3:
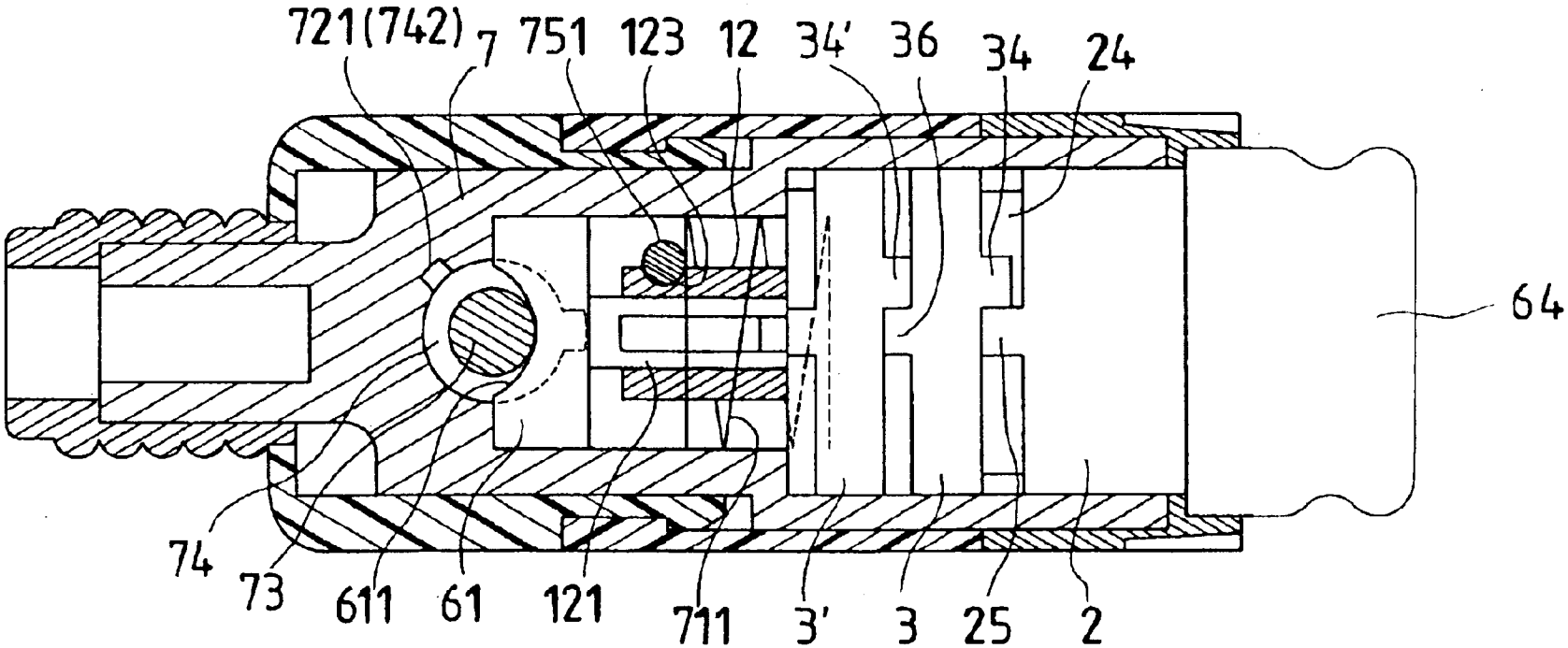
FIG. 3 is a horizontal section of the combination lock according to the present invention.
Figure 4:
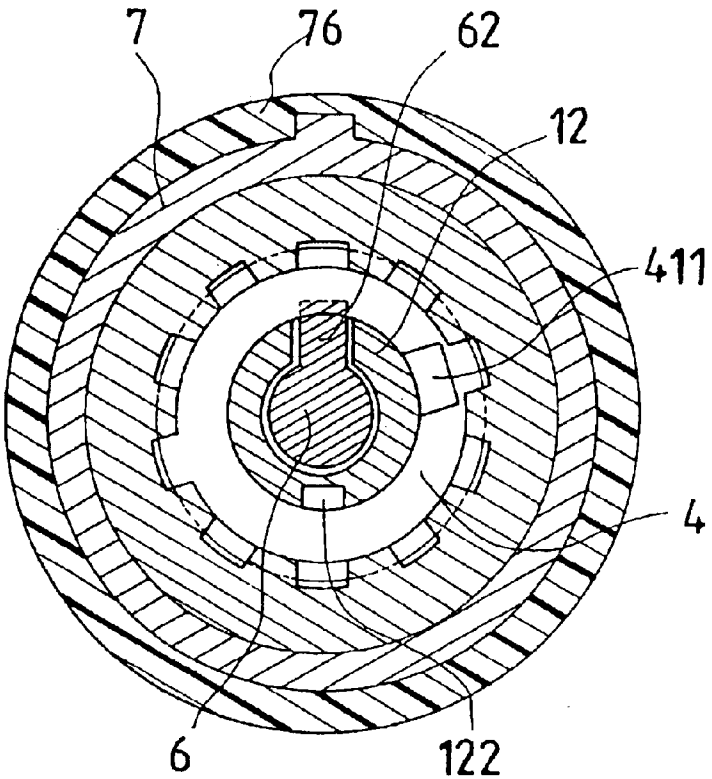
FIG. 4 is another vertical section of the combination lock according to the present invention.

Referring to FIGS. 1 to 3, a preferred embodiment of a combination lock in the present invention includes:

a female member 1 including a holding tube 12, and a rim 11 formed at a rear end of the holding tube 12; the rim 11 is formed with two curved trenches 111 in opposite directions, two gaps 112 on edges of opposite directions, and a middle hole 113 on the middle; the holding tube 12 has a trench 121 along the whole length thereof, an elongated locating recess 122 (FIG. 4), and an engaging recess 123 (FIG. 3) near to a front end;

a push ring 13 arranged around the holding tube 12 of the female member 1; the push ring 13 has two opposing plate portions 131 projecting from one side, and two opposing pushing projections 132 on the other side; the plate portions 131 are inserted in respective ones of the curved trenches 11 of the female member 1;

a pushed ring 14 arranged around the holding tube 12; the pushed ring 14 has a through hole 141, a locating protrusion 142 formed on an inner side thereof, and curved sloping portions 143; the curved sloping portions 143 are in contact with respective pushing projections 132 of the push ring 13 such that a forward pushing force is exerted on the pushed ring 14 when the push ring 13 is turned for the pushing projections 132 to move to higher ends of the curved sloping portions 143; the locating protrusion 142 is held in the locating recess 122 of the female member 1 so that the pushed ring 14 can't turn relative to the female member 1;

a dial 2 having a holding tube 21, several numerals equidistantly spaced on an outer side, teeth spaced out on an annular inner side, corresponding holding spaces 221 of the numerals between the teeth, and locating notches 23 of equal sizes next to the holding spaces 221; the dial 2 is further formed with a step-shaped portion 24 on a front side, and a moving protrusion 25 on the step-shaped portion 24 (FIG. 3);

first, second, and third co-moving rings 4, 4', and 4"; each co-moving ring has a holding hole 41, a gap 411 on an inward edge, a rim 42, and two opposing engaging blocks 43 (43', 43") on the rim 42; the co-moving ring 4 is arranged around the holding tube 12 and held in the dial 2 such that it is releaseably engaged with the dial 2 with the engaging blocks 43 being held in the holding spaces 221, and such that the gap 411 faces an opposite direction of a corresponding numeral on the dial 2;

first, second, and third locating rings 5, 5', and 5", each of which has a holding hole 51, a gap 511 on an inward edge thereof, a locating protrusion 512, on the inward edge, two recesses 52, and a trench 53, which is formed between the recesses 52 and forms an angle; each locating ring 5, 5', 5" has an elastic locating element 54 tightly and securely fitted in the trench 53 thereof; the elastic locating elements 54 have two ends 541 projecting out from edges of respective locating rings 5, 5', 5"; the first locating ring 5 is arranged around the holding tube 12 and held in the dial 2 such that the locating protrusion 512 is fitted in the locating recess 122 of the female member 1 to prevent rotation of the ring 5 relative to the holding tube 12, and the gap 511 opposes the trench 121 of the female member 1, and such that the elastic locating element 54 is fitted in the locating notches 23 at the ends 541 for locating the dial 2 and producing ticktack when the dial 2 is being operated;

first and second actuating rings 3, 3', each of which has a holding hole 31, teeth spaced out on an annular inner side, holding spaces 32 between the teeth, and locating notches 33 of equal sizes next to the holding spaces 32; each of the actuating rings 3, 3' is further formed with a first projecting portion 34 on a rear side, a step-shaped portion 35 on a front side, and a second projecting portion 36 on the step-shaped portion 35; the first actuating ring 3 is arranged around the holding tube 12 of the female member 1 and next to the dial 2 such that the moving protrusion 25 of the dial 2 will come into contact with the first projecting portion 34 thereof during the course of the dial 2 being operated; the co-moving ring 4', and the locating ring 5' are arranged around the holding tube 12 and held in the first actuating ring 3 such that the locating protrusion 512 of the locating ring 5' is fitted in the locating recess 122 to prevent rotation of the ring 5' relative to the holding tube 12, the gap 511 of the locating ring 5' opposes the trench 121, and the corresponding elastic locating element 54 is fitted in the locating notches 33 at two ends 541 for locating the actuating ring 3 and producing ticktack when the actuating ring 3 is being turned, and such that the co-moving ring 4' is releaseably engaged with the first actuating ring 3 at the engaging blocks 43' thereof;

the second actuating ring 3' is arranged around the holding tube 12 and next to the first actuating ring 3 such that the second projecting portion 36 of the first actuating ring 3 will come into contact with first projecting portion 34' thereof during the course of the first actuating ring 3 being rotated; the co-moving ring 4", and the locating ring 5" are arranged around the holding tube 12 and held in the second actuating ring 3' such that they can function in the same way as the co-moving ring 4', and the locating ring 5';

an operating body 64 arranged on the rear side of the rim 11 of the female member 1; the operating body 64 has a fitting tube 641 (FIG. 8), and two engaging protrusions 644 (FIG. 8), and is fitted around the plate portions 131 of the push ring 13 at two connecting portions 643 thereof; the engaging protrusions 644 are normally fitted in the gaps 112 of the female member 1 to prevent rotation of the operating body 64 relative to the female member 1;

a lock rod 6 inserted in the female member 1, and projecting out from the middle hole 113 of the rim 11; the lock rod 6 has an engaging block portion 61 at a front end, teeth 62 spaced out along a middle section, and a rear fitting portion 63; the teeth 62 project out from the opening of the trench 121; the block portion 61 has a curved concavity 611 while the rear fitting portion 63 has an engaging trench 632; a spring 631 is disposed around the rear fitting portion 63 to bias the lock rod 6 forwards while a pin 642 is inserted through the fitting tube 641 of the operating body 64 and held in the engaging trench 632 to connect the lock rod 6 and the operating body 64;

a lock shell 7 having a holding room 71, a pin hole 75, a holding hole 72 perpendicular to the holding room 71, and two guide trenches 721, 722 adjacent to the holding hole 72; the actuating rings 3, 3', and the holding tube 21 of the dial 2 are disposed in the holding room 71 while a pin 751 is inserted in the pin hole 75, and fitted on the engaging recess 123 of the female member 1 to connect the female member 1 and the lock shell 7; a big spring 711 is disposed in the holding room 71 to come into contact with the locating ring 5" for biasing the co-moving rings 4, 4', 4" towards the rear end of the tube portion 12;

a locking insertion rod 73 separably inserted in the holding hole 72 of the lock shell 7 for releaseably engaging the engaging block portion 61 of the lock rod 6; a spring 741 is held in the holding hole 72 while a cap 74 is disposed on top of the spring 741 such that the locking insertion rod 73 is biased outwardly of the holding hole 72 by the spring 741 after it is inserted in the hole 72; the cap 74 has protrusions 742, 743, which are respectively fitted in the guide trenches 721, 722 so that the cap 74 can move more smoothly; and an outer shell 76 comprised of first and second parts 761, 762 connected together, and disposed around the lock shell 7 for making the present lock attractive; the part 762 has a position sign 763, and two arrow sings 764 respectively pointing to clockwise and counterclockwise directions for helping the user turn the dial 2 exactly to desired positions in operating the present combination lock.

Figure 8:
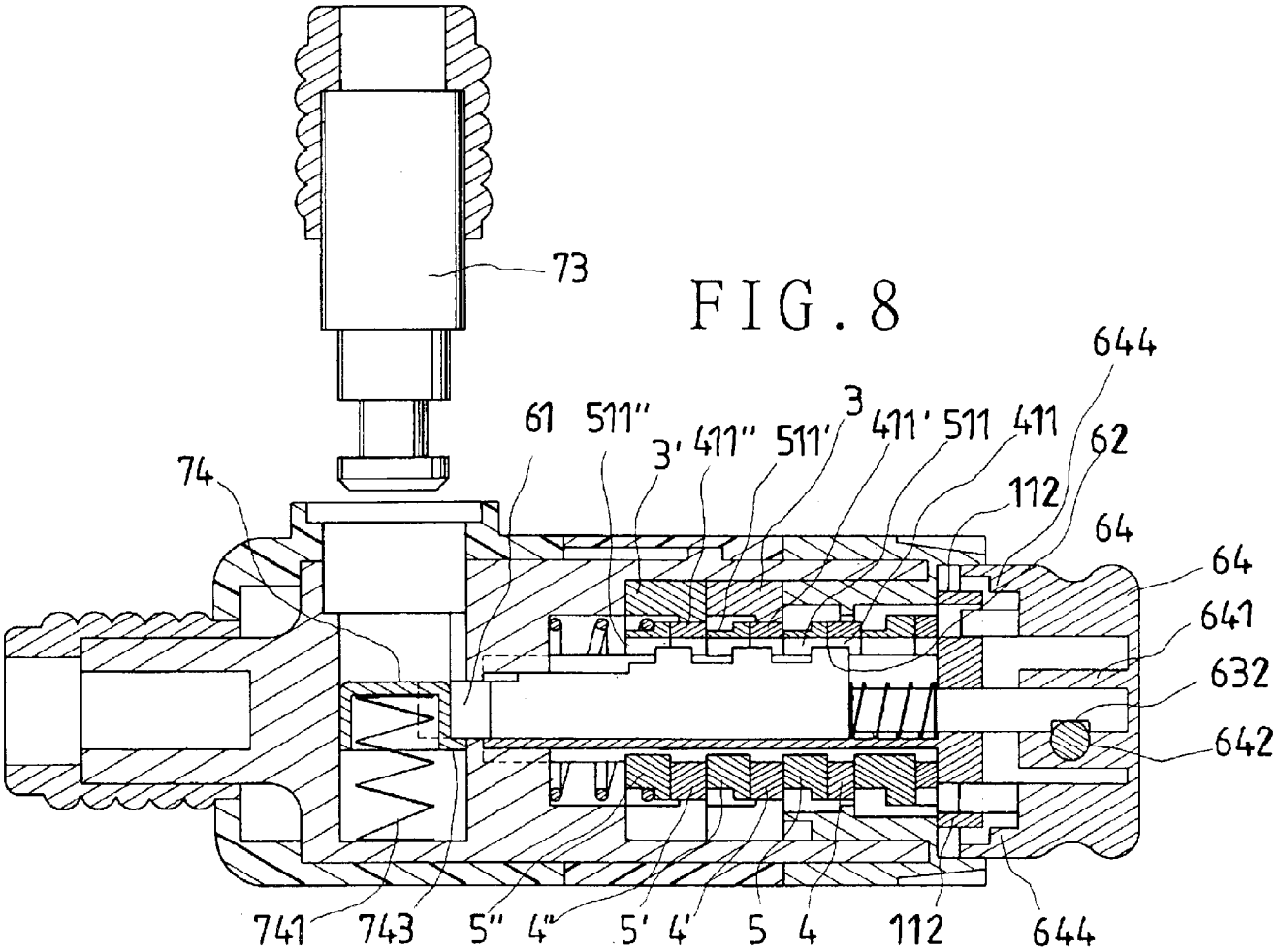
FIG. 8 is a cross-sectional view of the combination lock of the present invention in use (3)
Figure 9:
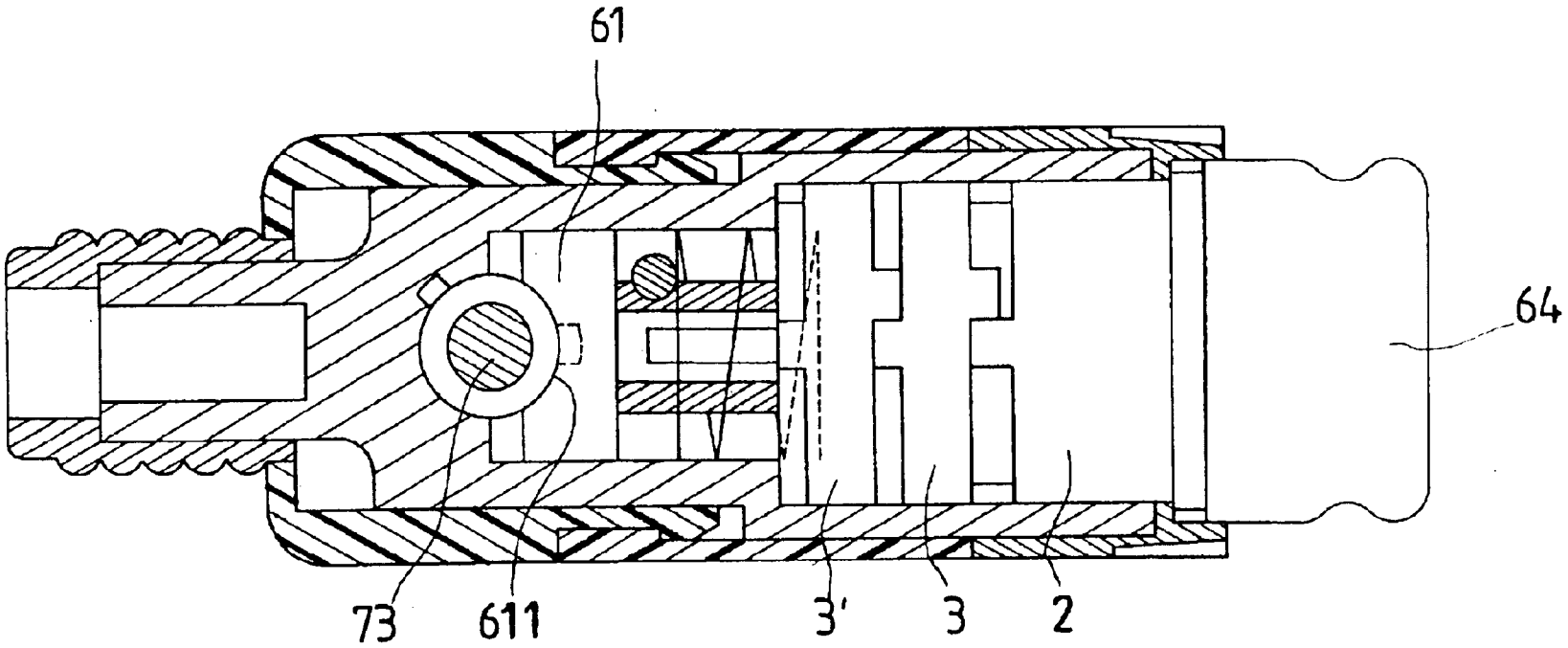
FIG. 9 is a view of the combination lock of the present invention in use (4)
Figure 10:
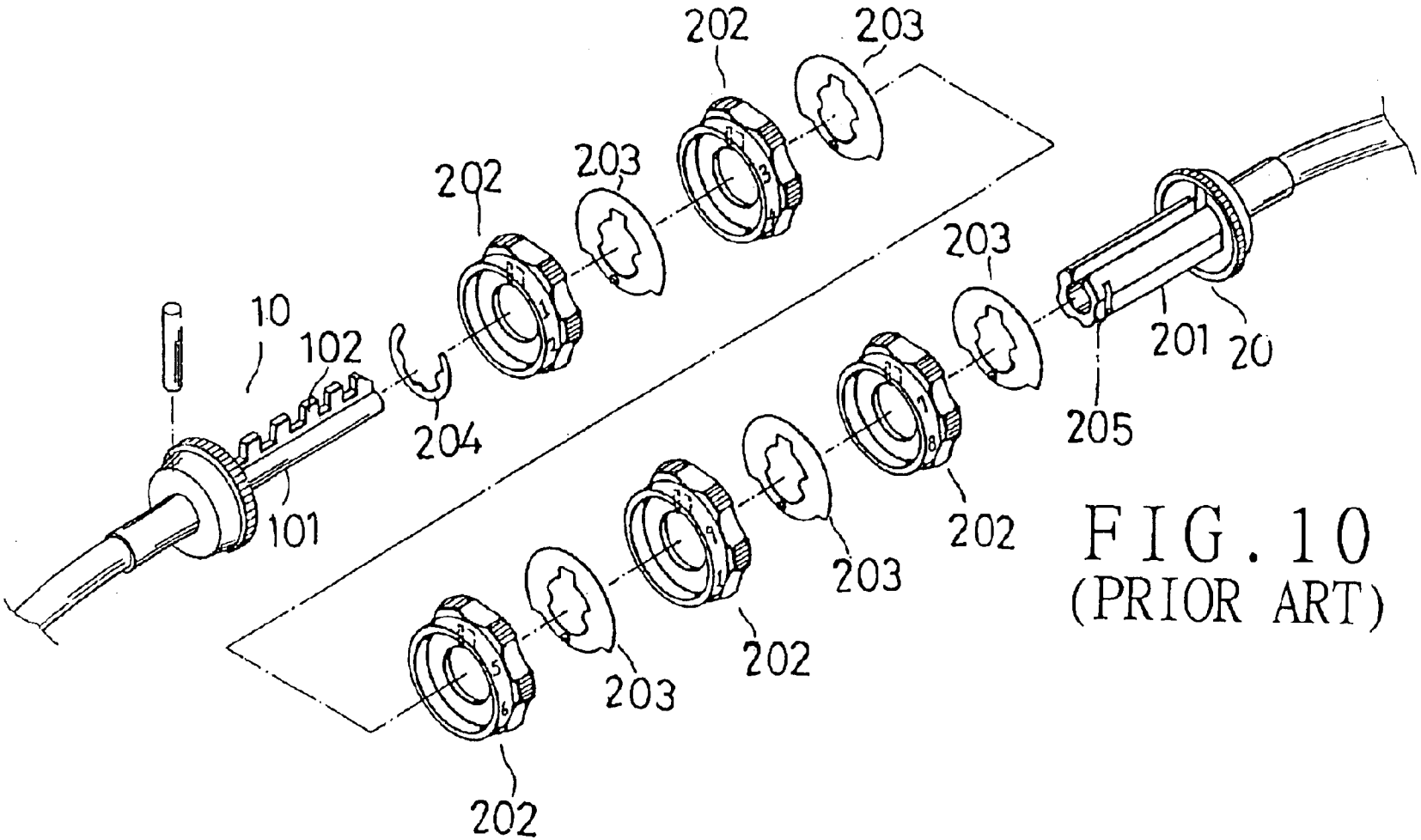
FIG. 10 (PRIOR ART)
FIG. 10 is an exploded perspective view of the conventional combination lock as described in the Background.

In assembling the present lock, the pushing projections 132 of the push ring 13 are located on the lowermost ends of the sloping portions 143 of the pushed ring 14, the engaging blocks 43, 43', 43" of the co-moving ring 4, 4', 4" respectively held in the holding spaces 221, 321, 321', and the gaps 411 of the co-moving ring 4, 4, 4" faced with the trench 121 of the female member 1 such that the gaps 511, 411 of the locating rings 5, 5', 5" and the co-moving rings 4, 4', 4" are aligned to form a passage adjacent to the trench 121; the first projecting portion 34 of the first actuating ring 3 will be located on the step-shaped portion 24 of the dial 2, and the first projecting portion 34' of the second actuating ring 3' will be located on the step-shaped portion 35 of the first actuating ring 3. And, the lock rod 6 is inserted in the holding tube 12 with the teeth 62 thereof passing through the trench 121 as well as the gaps 511, 411. Then, the lock shell 7 is disposed around the actuating rings 3, 3' and the holding tube 21 of the dial 2, and secured to the female member 1 by means of the pin 751 after the outer shell 76, the cap 74, and the locking insertion rod 73 are fitted to the lock shell 7. And, the operating body 64 is fitted around the plate portions 131 of the push ring 13 at the connecting portions 643 thereof, and connected to the rear fitting portion 63 of the lock rod 6 with the pin 642. Thus, the cap 74 will be pushed towards an upper end of the holding hole 72 of the lock shell 7 by the spring 741 when the operating body 64 is pulled away from the rim 11 of the female member 1; the protrusion 743 of the cap 74 will come into contact with the engaging block portion 61, and in turns, the cap 74 is stopped from moving out of the holding hole 72, as shown in FIG. 8.

Figure 6:
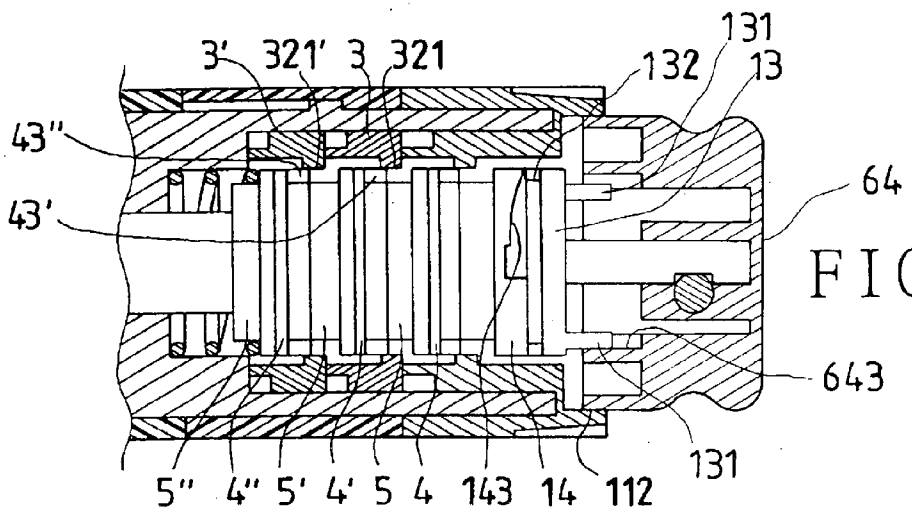
FIG. 6 is a partial cross-sectional view of the combination lock of the present invention in use (1)

The present lock is provided to a buyer in the unlocked position, i.e. the lock rod 6 can be moved rewards of the female member 1, such that the buyer can set the unlocking numeral combination of the lock. To set the combination, the operating body 64 is first turned such that the pushing projections 132 of the push ring 13 are relocated on the highest ends of the sloping portions 143, and the pushed ring 14 pushed forwards (FIG. 6), and in turns, the co-moving rings 4, 4', 4" as well as the locating rings 5, 5', 5" move towards front end of the female member 1, and the engaging blocks 43, 43', 43" separate from corresponding holding spaces 221, 321, 321'; thus, the co-moving rings 4, 4', 4" respectively disengage the dial 2, the rings 3, 3'. Then, the dial 2 is turned in a first direction more than three circles (one thousand and eighty degrees) such that one of the numerals on the dial 2 will be the first numeral of the unlocking combination that is nearest to the position sign 763 of the outer shell 76 when the rotation of the dial 2 finishes; the second projecting portion 36 of the first actuating ring 3 will come into contact with the first projecting portion 34' of the second actuating ring 3', and the second actuating ring 3' will begin to turn together with the dial 2 after the dial 2 is turned more than three circles; the co-moving rings 4, 4, 4" won't turn together with the dial 2 or the actuating rings 3, 3'. Third, the dial 2 is turned more than one circle and less than two circles (360 to 720 degrees) in a second direction opposite the first one such that one of the numerals on the dial 2 will be the second numeral of the unlocking combination that is adjacent to the position sign 763 when the second rotation of the dial 2 finishes; the moving protrusion 25 of the dial 2 will come into contact with the first projecting portion 34 of the first actuating ring 3, and the first actuating ring 3 will begin to turn together with the dial 2 after the dial 2 has been turned one circle; the actuating ring 3' won't turn until the dial 2 is turned more than two circles. Fourth, the dial 2 is turned less one circle in the first direction such that only the dial 2 is turned relative to the co-moving ring 4, and such that one of the numerals on the dial 2 will be the third numeral of the unlocking combination that is nearest to the position sign 763 when the third rotation of the dial 2 finishes. And finally, the operating body 64 is turned until the pushing projections 132 are located on the lowermost ends of the sloping portions 143 such that the engaging protrusions 644 oppose the gaps 112, and after the turning motion, the body 64 is released, and biased towards the rim 11 by the spring 631 such that the engaging protrusions 644 engage the rim 11, and such that the pushed ring 14, the locating rings 5, 5', 5", and the co-moving rings 4, 4', 4" are moved closer to the rim 11 by the big spring 711. Consequently, the engaging blocks 43, 43', 43" are again respectively held in corresponding holding spaces 221, 321, 321' for the co-moving ring 4, 4', 4" to be capable of turning together with the dial 2, the rings 3, 3' respectively. At the time, the operating body 64 will become incapable of disengaging the rim 11, i.e. the combination unchangeable, in case the dial 2 is turned such that the co-moving rings 4, 4', 4" turn away from respective unlocking orientations to be stopped from moving along the tube portion 12 of the female member 1 by the teeth 62 of the lock rod 6; the lock rod 6 will be also stopped from moving relative to the female member 1 by the co-moving rings 4, 4', 4" after the rings 4, 4', 4" turn away from the unlocking orientations, and in turns, the present lock will be in the locking position.

Figure 7:
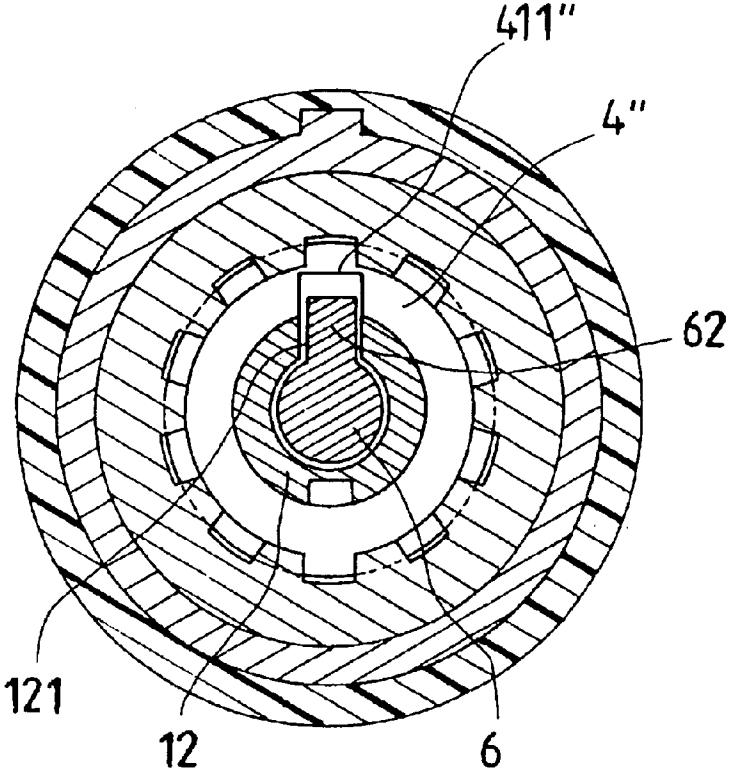
FIG. 7 is a vertical section of the combination lock of the present invention in use (2)
Figure 5:
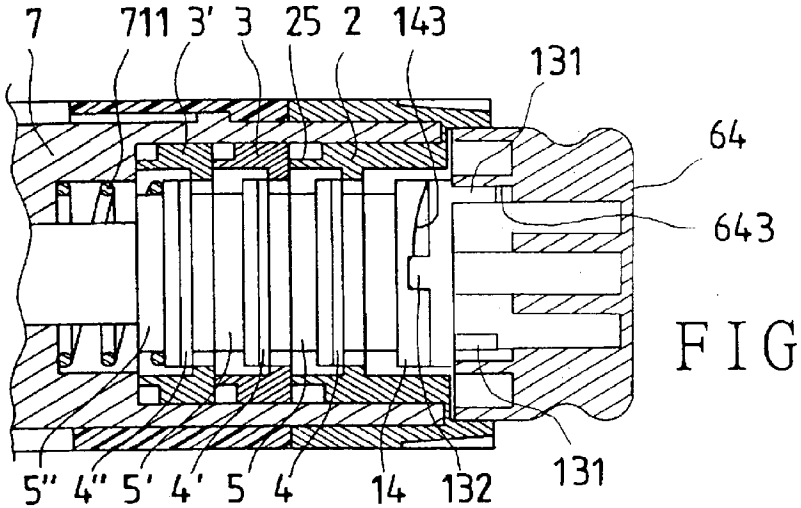
FIG. 5 is a partial vertical section of the combination lock according to the present invention.

In operating the lock for making the same unlock, first the dial 2 is turned in the first direction more than three circles such that the second actuating ring 3' is turned together. And, the dial 2 is turned such that the first unlocking numeral is adjacent to the position sign 763 for the gap 411" of the third co-moving ring 4" to oppose the trench 121 of the female member 1, as shown in FIG. 7. Then, the dial 2 is turned one circle in the second direction such that the first actuating ring 3 is turned together. And after the above turning operation, the dial 2 is turned less than one circle until the second unlocking numeral is adjacent to the position sign 763 for the gap 411 of the second co-moving ring 4' to oppose the trench 121 of the female member 1. Third, the dial 2 is turned no more than one circle (three hundred and sixth degrees) in the first direction until the third unlocking numeral is adjacent to the position sign 763 for the gap 411 of the co-moving ring 4 to oppose the trench 121; during the above turning operation, the first actuating ring 3 won't turn together with the dial 2 because the moving protrusion 25 doesn't come into contact with the first projecting portion 34. Consequently, all of the gaps 411, 411', 411", 511, 511', 511" oppose the trench 121 to form a passage, which allows the teeth 62 of the lock rod 6 to pass through. The block portion 61 will disengage the locking insertion rod 73, and the rod 73 is made to separate from the lock shell 7 by the spring 741 when the operating body 64 is pulled to effect movement of the lock rod 6 together with it to the releasing position. When the lock rod 6 is in the releasing position, the teeth 62 will be held in the gaps 411, 411', 411" to prevent the dial 2, and the actuating rings 3, 3' from turning; thus, the unlocking combination won't be changed due to accidental rotation of the dial 2 or the actuating rings 3, 3'.

To use the lock, the dial 2 is rotated to move the rings 4, 4', 4" away from respective unlocking orientations after the locking insertion rod 73 has been inserted in the holding hole 72, and the lock rod 6 made to project into the hole 72 to engage the rod 73 by the spring 631; thus, the lock rod 6 can't move, and the insertion rod 73 can't separate from the lock shell 7.

From the above description, it can be easily understood that the combination lock of the invention has advantages as followings:

1. The user only has to operate single dial therefore the combination lock is convenient to use.
2. The lock can be changed in the unlocking combination for suiting the user's need and increasing security.

What is claimed is:

1. A combination lock, comprising a female member including a holding tube, and a rim formed at a rear end of the holding tube; the rim having two curved trenches, and a middle through hole; the holding tube having a trench formed along a whole length thereof, an elongated locating recess, and an engaging recess near to a front end;

a push ring arranged around the holding tube of the female member; the push ring having two plate portions projecting out from respective curved trench of the female member; the push ring having two pushing projections on a front side;

a pushed ring arranged next to the push ring and around the holding tube of the female member; the pushed ring having a locating protrusion fitted in the elongated locating recess so as not to rotate on the holding tube; the pushed ring having curved sloping portions in contact with respective pushing projections of the push ring such that a forward pushing force is exerted on the pushed ring when the push ring is turned so as to move the pushing projections to higher ends of the sloping portions;

a dial arranged around the holding tube; the dial having a holding tube, and a plurality of spaced numerals on an outer side; the dial having teeth spaced out on an annular inner side, and corresponding holding spaces of the numerals between the teeth thereof; the dial having locating notches of equal size on an annular inner side; the dial having a step-shaped portion on a front end, and a moving protrusion projecting forwards from the step-shaped portion;

a plurality of co-moving rings arranged around the holding tube of the female member; each co-moving ring having a gap on an inward edge, a rim, and two engaging blocks on the rim; a first one of the co-moving ring being held in the dial to be releaseably engaged with the teeth of the dial at the engaging blocks thereof;

locating rings arranged next to respective co-moving rings and around the holding tube of the female member; each locating ring having a locating protrusion fitted in the elongated locating recess so as not to rotate on the holding tube; each locating ring having a gap on an inward edge thereof; elastic locating elements being secured to respective locating rings with two ends projecting out from edges of the locating rings; a first one of the locating rings being held in the dial with the gap opposing the trench of the female member, and with two ends of the elastic locating element being fitted in the locating notches of the dial;

actuating rings arranged side by side next to the dial and around respective co-moving rings as well as respective locating rings; each actuating ring having teeth spaced out on an annular inner side, holding spaces between the teeth, and locating notches of equal size on an annular inner side; each actuating ring having a first projecting portion on a rear side, a step-shaped portion on a front side, and a second projecting portion projecting forwards from the step-shaped portion; the co-moving rings, except for the first one, being releaseably engaged with the teeth of respective actuating rings at the engaging blocks thereof so as to be capable of rotating together with respective actuating rings;

rotation of the dial and the actuating rings being incapable of effecting rotation of respective co-moving rings together with them when the co-moving rings are disengaged from them; the locating rings, except for the first one, being held in respective actuating rings with the gaps thereof opposing the trench of the female member, and with two ends of the elastic locating elements being fitted in the locating notches of the actuating rings;

the moving protrusion of the dial being capable of coming into contact with the first projecting portion of a first one of the actuating rings during a course of the dial being operated, thus making the first actuating ring turn together with the dial;

the second projecting portion of each actuating ring being capable of coming into contact with the first projecting portion of an adjacent actuating ring arranged in front of it during a course of the former actuating ring being rotated, thus making the front adjacent actuating ring turn together with the rear adjacent one;

an operating body arranged on a rear side of the rim of the female member and fitted around the plate portions of the push ring for causing the push ring to rotate together with it;

a lock rod inserted through the holding tube of the female member, and projecting out from the middle hole of the rim of the female member at a rear end; the lock rod having teeth spaced out thereon and projecting out from an opening of the trench of the female member; the lock rod being secured to the operating body at the rear end thereof; the lock rod being biased forwards by a first spring;

a lock shell receiving a front portion of the holding tube of the female member, the actuating rings and the holding tube of the dial in a holding room thereof, and secured to the female member; the lock shell having a holding hole perpendicular to the holding room; a second spring being disposed in the holding room for biasing the co-moving rings to a first position; and a locking insertion rod separably inserted in the holding hole of the lock shell for releaseably engaging a front end of the lock rod; a cap-equipped spring being held in the holding hole for pushing the locking insertion rod outwardly of the holding hole after the lock rod disengages the locking insertion rod;

whereby allowing the co-moving rings to be rotated to respective unlocking positions, in which the gaps of the co-moving rings form a passage opposing the trench of the female member for the teeth of the lock rod to pass through, by means of rotating the dial, and whereby allowing unlocking numeral combination to be changed when the lock is in unlocking position by means of rotating the dial to change orientations of the dial and the actuating rings relative to respective co-moving rings after the operating body has been rotated so as to make the pushing projections of the push ring move to higher ends of the sloping portions of the pushed ring.

2. The combination lock as claimed in claim 1, wherein the female member has a plurality of gaps on an edge thereof while the operating body has engaging protrusions opposing the rim of the female member to be fitted in respective ones of the gaps of the female member to prevent rotation of the operating body relative to the female member.

3. The combination lock as claimed in claim 1, wherein the female member has an engaging recess near to the front portion held in the lock shell while the lock shell has a pin hole; a pin being inserted through the pin hole and fitted in the engaging recess for connecting the female member to the lock shell.

4. The combination lock as claimed in claim 1, wherein each of the locating rings has two recesses, and a trench, which is formed between the recesses and forms an angle, while the elastic locating elements are tightly and securely fitted in respective ones of the trenches of the locating rings.

5. The combination lock as claimed in claim 1, wherein the rear end of the lock rod has an engaging trench thereon while a pin is inserted in the operating body and fitted in the engaging trench to securely connect the lock rod to the operating body.

6. The combination lock as claimed in claim 1, wherein the lock shell has a plurality of guide trenches adjacent to the holding hole thereof while the cap of the spring provided for pushing the locking insertion rod has protrusions fitted in respective ones of the guide trenches.

7. The combination lock as claimed in claim 1, wherein an outer shell, which includes first and second parts connected together, is disposed around the lock shell.

8. The combination lock as claimed in claim 7, wherein an outer side of the outer shell is formed with a position sign, and two arrow sings respectively pointing to clockwise and counterclockwise directions.

* * * * *